US006126494A

United States Patent [19]

Fuchs et al.

[11] Patent Number: 6,126,494

[45] Date of Patent: Oct. 3, 2000

[54] ELECTRICAL CONNECTOR FOR A PRINTED-CIRCUIT BOARD

[75] Inventors: Helmut Fuchs, Halver; Dirk Pellizari, Wuppertal, both of Germany

[73] Assignee: Karl Lumberg GmbH & Co., Schalksmuhle, Germany

[21] Appl. No.: 09/199,913

[22] Filed: Nov. 25, 1998

[30] Foreign Application Priority Data

Nov. 29, 1997 [DE] Germany ..... 197 53 078

[51] Int. Cl.[7] ..... H01R 4/48

[52] U.S. Cl. ..... 439/835; 439/828; 439/441

[58] Field of Search ..... 439/835, 789, 439/828, 630, 834, 441, 260, 716

[56] References Cited

U.S. PATENT DOCUMENTS

| | | | |
|---|---|---|---|
| 3,648,220 | 3/1972 | Julinot | 439/438 |
| 4,082,407 | 4/1978 | Smorzaniuk et al. | 439/487 |
| 4,695,920 | 9/1987 | Klebba et al. | 439/806 |
| 5,860,837 | 1/1999 | Bock et al. | 439/828 |
| 5,895,286 | 4/1999 | Linke | 439/441 |
| 5,915,991 | 6/1999 | Roman | 439/835 |

FOREIGN PATENT DOCUMENTS

| | | | |
|---|---|---|---|
| 38 17 706 | 12/1988 | Germany . | |
| 37 10 394 | 8/1990 | Germany . | |
| 35 14 099 | 11/1994 | Germany . | |
| 35 14 097 | 12/1996 | Germany . | |
| 196 11 762 | 10/1997 | Germany . | |
| 0050992 | 4/1979 | Japan | 439/441 |
| 1188676 | 4/1970 | United Kingdom | 439/441 |

*Primary Examiner*—Paula Bradley
*Assistant Examiner*—Tho D. Ta
*Attorney, Agent, or Firm*—Herbert Dubno; Andrew Wilford

[57] ABSTRACT

A connector for electrically connecting a wire to a conductive strip on a face of a printed-circuit board has a dielectric housing formed with a cavity, with a slot extending from the cavity and adapted to receive an edge of the circuit board, and with a hole opening outward from the cavity and adapted to receive the wire. A conductive one-piece spring element in the cavity has a front arm extending at an angle at least partially across the slot and a rear arm extending across the hole, formed with an aperture alignable with the hole, and deflectable between a tensioned position with the aperture aligned with the hole and a rest position with the aperture offset from the hole. The wire is engageable through the aperture and hole in the tensioned position. Alternately the rear arm presses the wire directly against the conductive strip of the circuit board engaged in the slot.

10 Claims, 5 Drawing Sheets

ELECTRICAL CONNECTOR FOR A PRINTED-CIRCUIT BOARD

FIELD OF THE INVENTION

The present invention relates to a connector. More particularly this invention concerns a connector for connecting a wire to a conductive strip on a printed-circuit board.

BACKGROUND OF THE INVENTION

It is frequently necessary for input/output purposes, for example, to connect signal- and voltage-carrying wires to the conductors printed on the faces of printed-circuit boards. Typically this is done at the edge of the board where each printed conductor extends perpendicular to the edge as a thin strip.

In standard boards the connector is mounted on one face of the board as described in German 196 11 762 of Stadler. Here the connector has a pin that is pressed through a hole in the board and soldered in place and includes a seat for a wire end that can be clamped in place. In German 3,817,706 of Werk a clip is shown which engages through the board to press against both faces. This clip is elastically deformable to press a conductor of a wire against a face of the board. These systems are not usable in a system where contact must only be made with one face of the board, because the other face carries other conductors that must not be contacted.

The arrangement of German patent 3,710,394 of Eisert has a nonconducting housing that fits over an edge of the board in an exact fit and that has a tongue-like conductor engaging one face of the board. This arrangement will not work at all if the board is slightly too thick or too thin as the mount will be sloppy and the conductor will not make adequate contact with the conductor on the face of the board.

In related art, German patents 3,514,097 and 3,514,099 of Hohorst show systems for joining two wires where a single resilient conductor strip can be elastically deformed such that when it is released it captures and presses together the conductors of two wires. This system is very convenient for solderless coupling of two wires, but is not readily adaptable for use with a printed-circuit board.

OBJECTS OF THE INVENTION

It is therefore an object of the present invention to provide an improved electrical connector for a printed-circuit board.

Another object is the provision of such an improved electrical connector for a printed-circuit board which overcomes the above-given disadvantages, that is which is of simple construction and which can form a good mechanical and electrical connection with the board without soldering.

SUMMARY OF THE INVENTION

A connector for electrically connecting a wire to a conductive strip on a face of a printed-circuit board has according to the invention a dielectric housing formed with a cavity, with a slot extending from the cavity and adapted to receive an edge of the circuit board, and with a hole opening outward from the cavity and adapted to receive the wire. A conductive one-piece spring element in the cavity has a front arm extending at an angle at least partially across the slot and a rear arm extending across the hole, formed with an aperture alignable with the hole, and deflectable between a tensioned position with the aperture aligned with the hole and a rest position with the aperture offset from the hole. The wire is engageable through the aperture and hole in the tensioned position.

With this system therefore the spring element wholly contained in the dielectric housing serves to clamp both the wire and circuit board in place and serves also to connect them electrically together. The connector according to the invention is fitted to the edge of a circuit board and the wire is then inserted into the housing, forming the desired electrical connection between this wire and the conductive path on the circuit board.

In accordance with the invention the housing is formed with an abutment and the rear arm normally presses the wire against the abutment. The housing is further formed with a pivot pin and with surfaces closely surrounding the pivot pin. The element extending between the surfaces and the pivot pin is snugly retained in place thereby. A web is formed on the housing adjacent the slot and the front arm is prestressed against this web. The rear arm extends transversely of the front arm and they are oriented such that when the front arm is pressed back to engage the circuit board, the rear arm presses more strongly against the wire and vice versa.

In this arrangement the spring element is conductive and normally engages the conductive strip of the board received in the slot. It therefore forms a conductive path between the printed-circuit strip and the wire.

In another arrangement according to the invention the rear arm extending across the hole presses the wire against the conductive strip of the circuit board engaged in the slot. Normally in this arrangement the rear arm is formed with an aperture alignable with the hole and through which the wire engages. This rear arm is V-shaped and has one leg formed with the aperture and another leg having a free end pressing the wire against the conductive strip. In this case the element is made of spring steel. With this arrangement the wire is connected directly to the circuit-board conductor so that the spring element does not form a conductive path between them.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
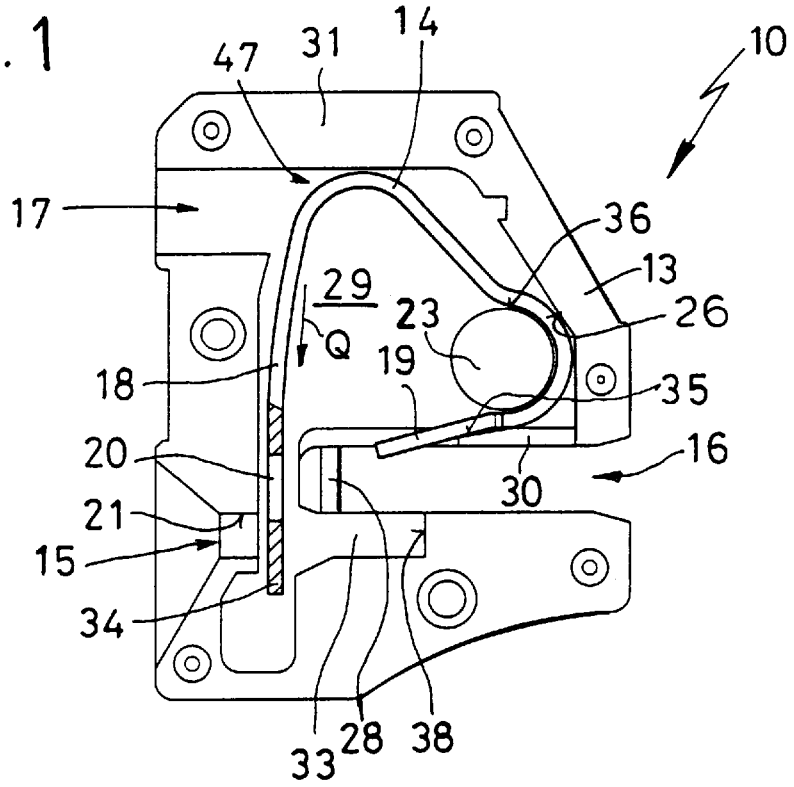
FIG. 1 is a side view partly in section of a connector according to the invention in the unconnected condition.

As seen in FIGS. 1, 2, 3, 4, 5, and 7 a connector 10 according to the invention has a housing 13 formed by an end plate 2, edge blocks 31, a web 30, and a mounting pin 23 together defining a central cavity 29 that is open on one side via a slot 16 and on the opposite side via holes 15 and 17. In the cavity 29 is a spring/conductor element 14 having a rear arm 18 extending across the hole 15, a central portion 32, and another arm 19 braced between the pin 23 and web 30 and normally projecting at a very acute angle somewhat into the slot 16. In the FIG. 1 position, with the connector not mounted on a board 12 or connected to a wire 11, the element 14 bears upward and forward against surfaces 27 and 26 of the housing 13, downward against a surface 35 of the web 30, and downward and upward against outer surface 36 and 25 of the mounting pin 23, so that it is very solidly held in place. In this position an end portion 34 of the element 14 is aligned with the hole 15.

Figure 2:
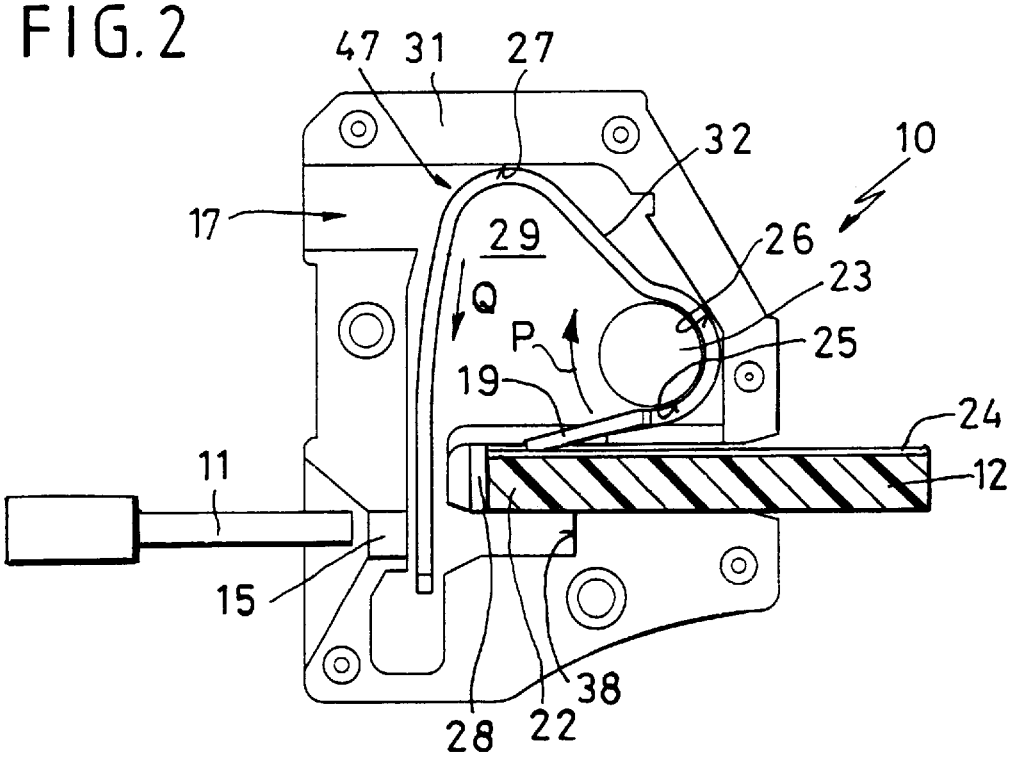
FIG. 2 is a view like FIG. 1 showing the connector fitted to a printed-circuit board.
Figure 3:
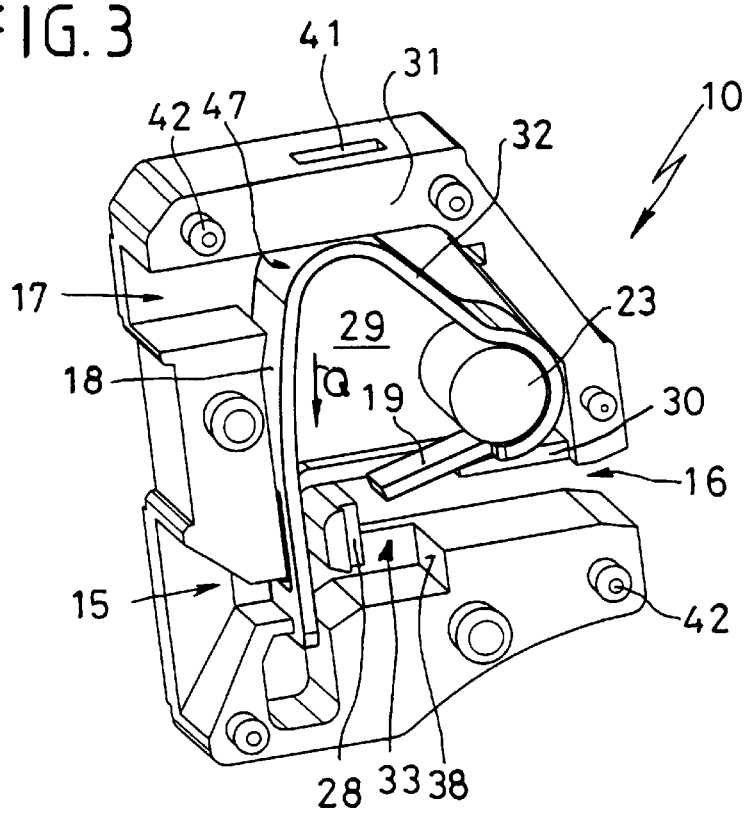
FIGS. 3 and 4 are perspective views of the structures as in respective FIGS. 1 and 2.
Figure 4:
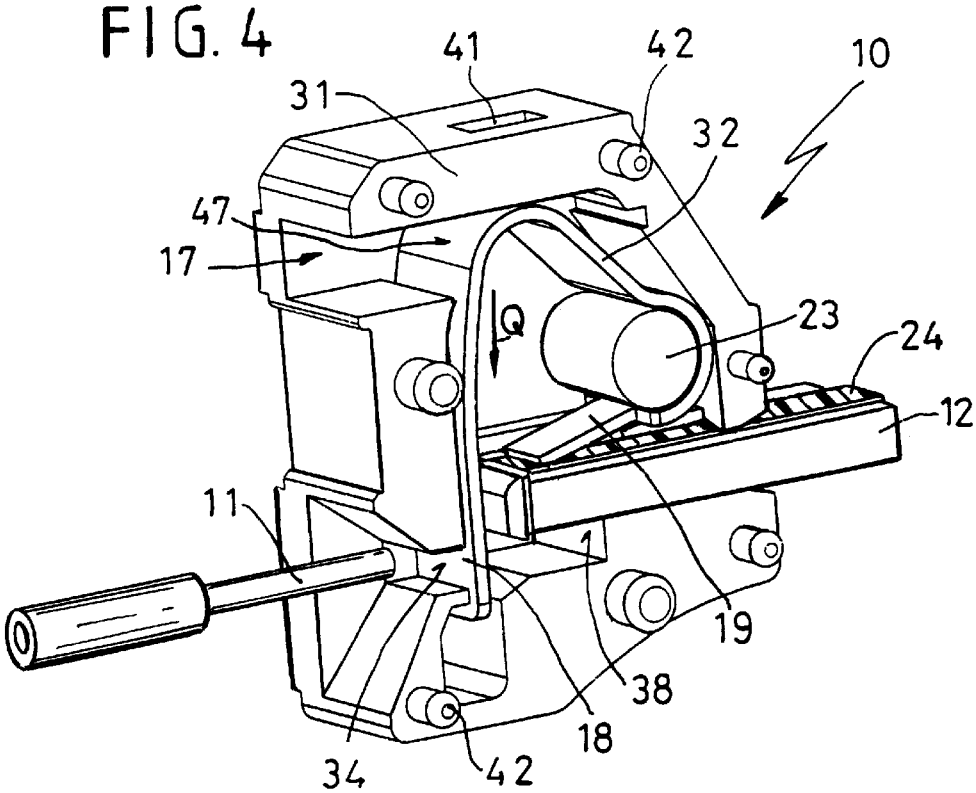
Figure 5:
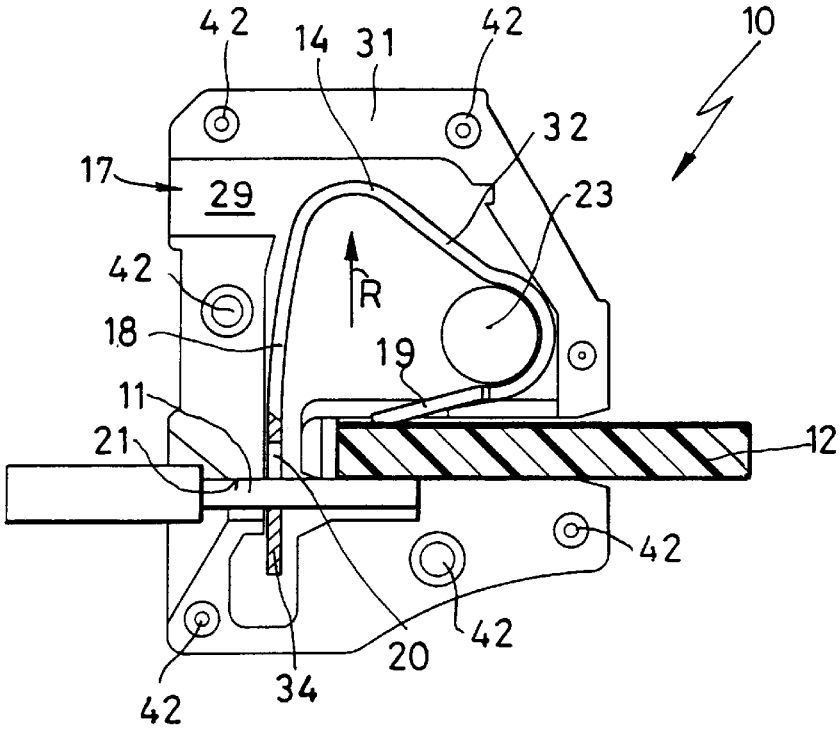
FIG. 5 is a view like FIG. 1 showing the connector fitted to a printed-circuit board and to a wire.

FIGS. 2 and 4 show how the printed-circuit board 12 bearing on one face a conductive strip 24 is inserted into the slot 16 so that an edge 22 of the board 12 engages an abutment 28 formed by the housing. This action cams up the element arm 19 as shown by arrow P, but since the element 14 is effectively captured by the surfaces 25, 26, and 27, the result will simply be elastic deformation mainly around the pin 23 so as to press the free outer end of the arm 19 firmly against the conductive strip 24, forming a good electrical contact. The element 14 is made of a copper-beryllium alloy so as to be a good conductor of electricity and still be quite springy.

To connect to the wire 11 an unillustrated tool such as a screwdriver is inserted into the hole 17 to fit at 47 between the surface 27 formed by the top edge block 31 of the housing 13 and an uppermost portion of the element 14. Alternately a tool could be inserted through a port 41 (FIG. 3) in the top 31 of the housing 13. This action forces the arm 18 down as indicated by arrow Q so that an aperture 20 in the arm 18 aligns with the hole 15. The wire 11 is then poked into the hole 15 so it runs through the aperture 20 into a recess 33 and up against an abutment surface 38 formed by the housing 13, and then the unillustrated tool is withdrawn to allow the wire to move back up in direction R (FIG. 5), catching the wire 11 against an upper surface 21 of the hole 15 and forming a good electrical contact between the wire 11 and the element 14, whose opposite end is in good electrical contact with the strip 24 of the board 12.

Figure 6:
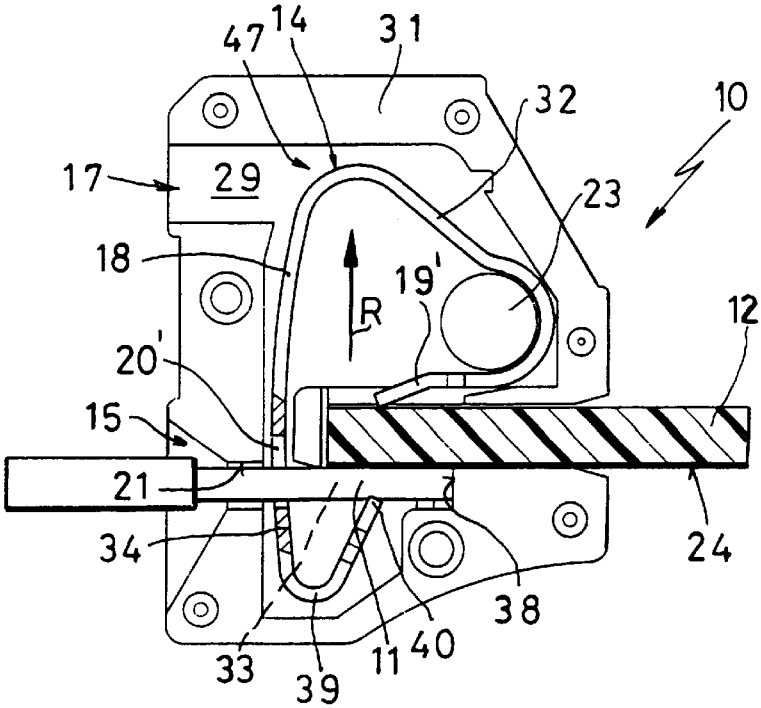
FIG. 6 is a view like FIG. 2 of an alternative arrangement according to the invention.
Figure 7:
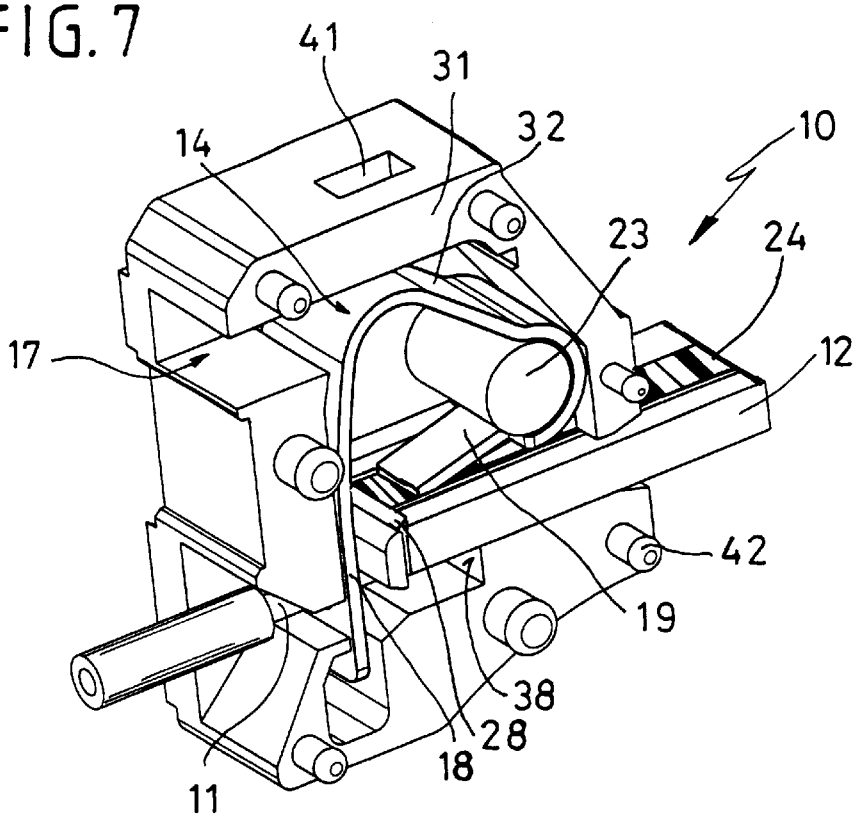
FIGS. 7 and 8 are perspective views of the structures as in respective FIGS. 5 and 6.
Figure 8:
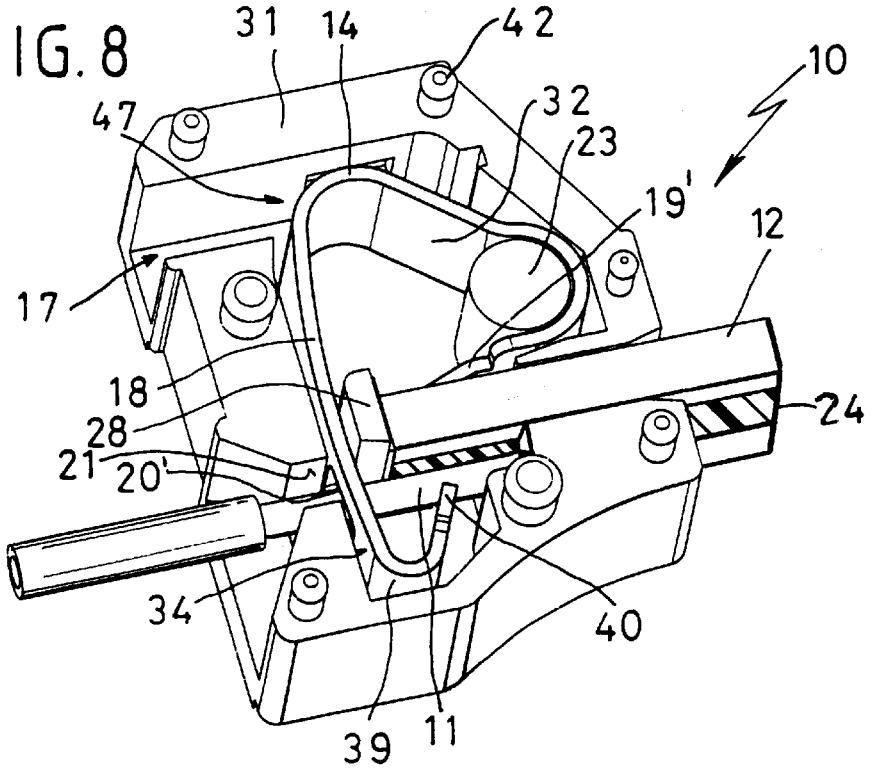

In the arrangement of FIGS. 6 and 8 the arm 18 of the element 14 is bent V-shaped at 39 and is extended upward as an end 40 and here the arm 18 is formed with a somewhat larger aperture 20'. In addition the arm 19' of the element 14 is bent down somewhat at its end so that it forms a less acute angle with the board 12.

With this system the board 12 is inserted with its strip 24 facing downward. The element arm 18 is deflected downward as before, sufficiently that the wire 11 can pass over the end 40. Then when the arm 18 is allowed to come up again, this end 40 will press the wire 11 directly against the conductive strip 24, making a good electrical contact between these parts and locking the wire 11 mechanically in place. Thus the element 14 can be made of less conductive spring steel, since it is not itself used to conduct electricity.

Figure 9:
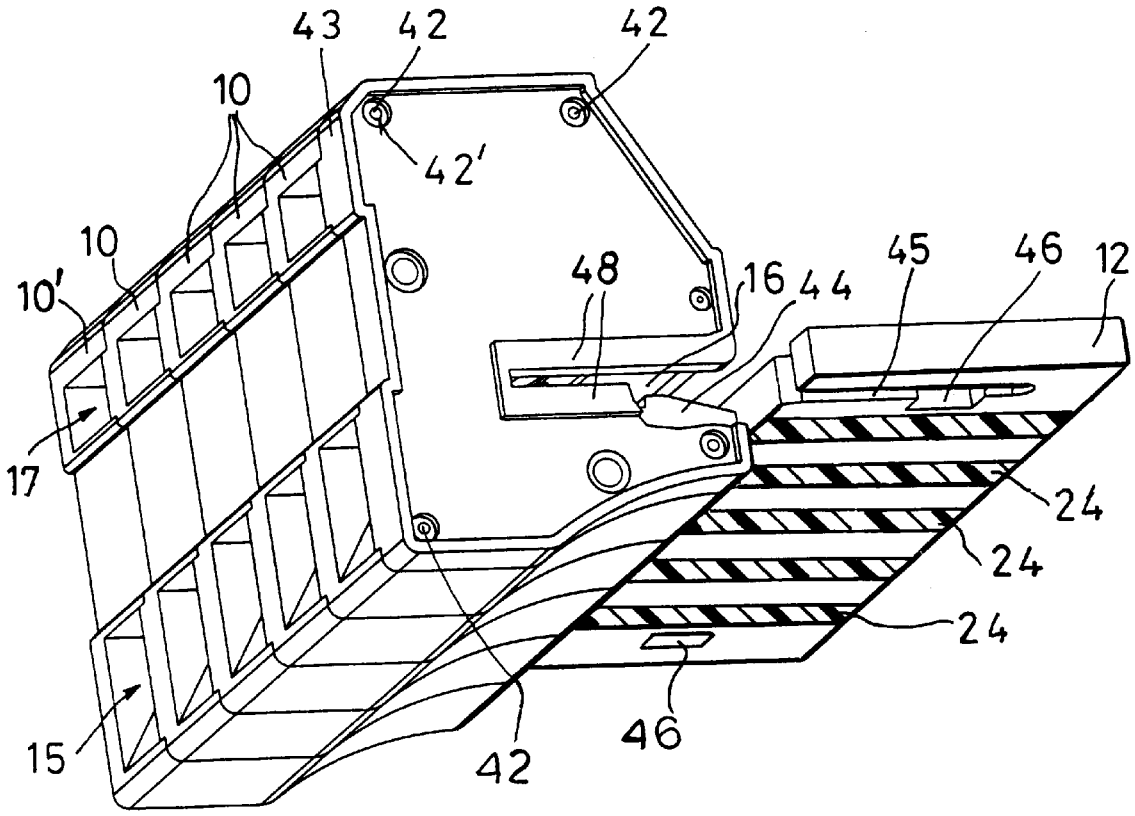
FIG. 9 is a perspective view showing a ganged connector assembly in accordance with the invention.

FIG. 9 shows how five connectors 10 and 10' can be ganged together. To this end the connectors have as shown in FIGS. 1 to 8 end studs 42 that can fit in complementary holes 42' in adjacent housings 13 or in an end plate 43. The end plate 43 and the opposite end connector 10' are provided with formations 48 and 44 that interfit with respective grooves and slots 45 and 46 cut in the board 12 so as to align the connectors 10 with the respective strips 24.

We claim:

1. A connector for electrically connecting a wire to a conductive strip on a face of a printed-circuit board, the connector comprising:

a dielectric housing formed with
- a cavity,
- a slot extending from the cavity and adapted to receive an edge of the circuit board, and
- a hole opening outward from the cavity and adapted to receive the wire; and a conductive one-piece spring element wholly in the cavity and having
- a front arm extending at an acute angle at least partially across the slot such that the front arm bears on and elastically retains the board when same is inserted in the slot, and
- a rear arm extending across the hole, formed with an aperture alignable with the hole, and deflectable between a tensioned position with the aperture aligned with the hole and a rest position with the aperture offset from the hole, the wire being engageable through the aperture and hole in the tensioned position.

2. A connector for electrically connecting a wire to a conductive strip on a face of a printed-circuit board, the connector comprising:

a dielectric housing formed with
- a cavity,
- an abutment,
- a slot extending from the cavity and adapted to receive an edge of the circuit board, and
- a hole opening outward from the cavity and adapted to receive the wire; and a conductive one-piece spring element in the cavity having
- a front arm extending at an angle at least partially across the slot, and
- a rear arm extending across the hole, formed with an aperture alignable with the hole, and deflectable between a tensioned position with the aperture aligned with the hole and a rest position with the aperture offset from the hole, the wire being engageable through the aperture and hole in the tensioned position with the rear arm pressing the wire against the abutment.

3. The electrical connector defined in claim 2 wherein the rear arm extends transversely of the front arm.

4. The electrical connector defined in claim 2 wherein the spring element is conductive and normally engages the conductive strip of the board received in the slot.

5. The electrical connector defined in claim 2 wherein the housing is formed with a pivot pin and with surfaces closely surrounding the pivot pin, the element extending between the surfaces and the pivot pin and being snugly retained in place thereby.

6. The electrical connector defined in claim 5 wherein the housing is formed adjacent the slot with a web and the front arm is prestressed against the web.

7. A connector for electrically connecting a wire to a conductive strip on a face of a printed-circuit board, the connector comprising:

a dielectric housing formed with
- a cavity,
- a slot extending from the cavity and adapted to receive an edge of the circuit board, and a hole opening outward from the cavity and adapted to receive the wire; and a conductive one-piece spring element wholly in the cavity and having a front arm extending at an acute angle at least partially across the slot such that the front arm bears on and elastically retains the board when same is inserted in the slot, and a rear arm extending across the hole and pressing the wire against the conductive strip of the circuit board engaged in the slot.

8. The electrical conductor defined in claim 7 wherein the element is made of spring steel.

9. The electrical conductor defined in claim 7 wherein the rear arm is formed with an aperture alignable with the hole and through which the wire engages.

10. The electrical conductor defined in claim 9 wherein the rear arm is V-shaped and has one leg formed with the aperture and another leg having a free end pressing the wire against the conductive strip.

* * * * *